US006257940B1

(12) United States Patent
Dunham et al.

(10) Patent No.: US 6,257,940 B1
(45) Date of Patent: Jul. 10, 2001

(54) OUTBOARD MOTOR WITH CENTRALIZED RIGGING

(75) Inventors: William D. Dunham, Waukegan; Harold L. Osborn, Winthrop Harbor, both of IL (US); Linda DeLine, deceased, late of Kenosha, WI (US), Allen DeLine, Executor

(73) Assignee: Outboard Marine Corporation, Waukegan, IL (US)

( * ) Notice: Subject to any disclaimer, the term of this patent is extended or adjusted under 35 U.S.C. 154(b) by 0 days.

(21) Appl. No.: 09/195,386

(22) Filed: Nov. 18, 1998

Related U.S. Application Data

(63) Continuation of application No. PCT/US97/10747, filed on Jun. 19, 1997.
(60) Provisional application No. 60/020,256, filed on Jun. 21, 1996.

(51) Int. Cl.[7] ..... B63H 20/32
(52) U.S. Cl. ..... 440/77; 440/113; 440/76
(58) Field of Search ..... 440/900, 84–86, 440/76, 77; 361/679, 730, 752, 736, 641; 174/52.3, 35 GC, 50; 307/10.1

(56) References Cited

U.S. PATENT DOCUMENTS

| | | | | |
|---|---|---|---|---|
| 4,697,782 | | 10/1987 | Ban . | |
| 4,932,875 | * | 6/1990 | Ogawa et al. | 439/271 |
| 4,933,809 | * | 6/1990 | Boede et al. | 440/77 |
| 4,969,847 | | 11/1990 | Curtis et al. . | |
| 5,105,334 | * | 4/1992 | Holinka | 440/76 |
| 5,203,292 | | 4/1993 | Motose . | |
| 5,207,186 | | 5/1993 | Okita . | |
| 5,282,764 | | 2/1994 | Glen . | |
| 5,637,021 | * | 6/1997 | Watanabe | 440/77 |
| 5,813,886 | * | 9/1998 | Shomura | 440/1 |

FOREIGN PATENT DOCUMENTS

| | | | | |
|---|---|---|---|---|
| 406211191 | * | 8/1994 | (JP) | 440/84 |

* cited by examiner

*Primary Examiner*—Ed Swinehart
(74) *Attorney, Agent, or Firm*—Armstrong Teasdale LLP

(57) ABSTRACT

An outboard motor includes a propulsion unit having a power head which includes an internal combustion engine, a lower unit including a drive shaft housing fixed to the engine and a propeller shaft joined by the lower unit driven by the engine and having thereon a propeller. A cowling extends over the engine downwardly to the drive shaft housing defining an enclosed space containing the engine. An opening is provided to the enclosed space proximate the juncture between the cowling and the drive shaft housing. A plurality of electrical cables enter the enclosed space through the opening. A sealed housing is mounted to a side of the engine and contains a plurality of electrical devises for operating the engine. The cables connect to preselected devices by means of water-tight connections on the housing. By such an arrangement, errors in wiring routing are reduced, electrical connections are made high on the power head where they can be kept away from moisture inside the cowling, and a sealed compartment is provided for the electrical devices protecting them from moisture and corrosion.

20 Claims, 1 Drawing Sheet

OUTBOARD MOTOR WITH CENTRALIZED RIGGING

CROSS-REFERENCE TO RELATED APPLICATION

This application is a continuation application of copending International Application Serial No. PCT/US97/10747, filed Jun. 19, 1997 claiming the benefit of U.S. provisional Application Serial No. 60/020,256, filed Jun. 21, 1996.

BACKGROUND OF THE INVENTION

The invention relates generally to marine propulsion devices, such as outboard motors. More particularly, the invention relates to electrical and other harness arrangements for such outboard motors, and to rigging of such arrangements.

In the past, typical outboard motor rigging was found at many locations on an outboard motor. Many times the connections were low on the power head and were difficult to access and susceptible to corrosion. Also in the past, wire routing was often left to the person rigging the outboard motor, with the result that the wires were often routed in a manner which interfered with other components or caused chafing of the wires against other components.

Attention is directed to the following U.S. Pat. Nos.

4,697,782, Ban, issued Oct. 6, 1987

5,203,292, Motose, issued Apr. 20, 1993

5,207,186, Okita, issued May 4, 1993

SUMMARY OF THE INVENTION

The invention provides an outboard motor comprising a propulsion unit including a power head including an internal combustion engine, a lower unit including a drive shaft housing fixed to the engine, and a propeller shaft journalled by the lower unit and having thereon a propeller, an outer cowling defining an enclosure containing the engine, and an electrical connection assembly mounted on the engine and within the engine enclosure and including at least two of a group of components including a fuse, a relay, a starter solenoid, a suppressor assembly, and an electrical plug-in connection adapted to be connected to a battery cable, and means connected to the propulsion unit and adapted to be mounted on a boat transom for permitting steering movement of the propulsion unit about a generally vertical axis relative to the boat and tilting movement of the propulsion unit about a generally horizontal axis relative to the boat.

The invention also provides an outboard motor comprising a propulsion unit including a power head including an internal combustion engine, a lower u nit including a drive shaft housing fixed to the engine, and a propeller shaft journalled by the lower unit and having thereon a propeller, an outer cowling extending to the drive shaft housing and defining an enclosure containing the engine, an electrical connection assembly mounted on the upper starboard side of the engine and within the engine enclosure and including a fuse, a relay, a starter solenoid, and an electrical plug-in connection, and an electrical power line entering through the opening into the engine enclosure and extending to the plug-in connection, and means connected to the propulsion unit and adapted to be mounted on a boat transom for permitting steering movement of the propulsion unit about a generally vertical axis relative to the boat and tilting movement of the propulsion unit about a generally horizontal axis relative to the boat.

The invention also provides an outboard motor comprising a propulsion unit including a power head including an internal combustion engine, a lower unit including a drive shaft A housing fixed to the engine, and a propeller shaft journalled by the lower unit and having thereon a propeller, an outer cowling extending to the drive shaft housing and defining an enclosure containing the engine, an opening located in the starboard side of one of the cowling and the drive shaft housing and communicating with the engine enclosure, an electrical connection assembly mounted on the upper starboard side of the engine and within the engine enclosure and including a fuse, a relay, a starter solenoid, and plug-in connections for all incoming electrical wiring, a fuel line entering through the opening into the engine enclosure, a shift cable entering through the opening into the engine enclosure, a throttle cable entering through the opening into the engine enclosure, and an electrical power line entering through the opening into the engine enclosure and extending to the electrical connection assembly, and means connected to the propulsion unit and adapted to be mounted on a boat transom for permitting steering movement of the propulsion unit about a generally vertical axis relative to the boat and tilting movement of the propulsion unit about a generally horizontal axis relative to the boat.

Other features and advantages of the invention will become apparent to those skilled in the art upon review of the following detailed description, claims and drawings.

Figure 3:
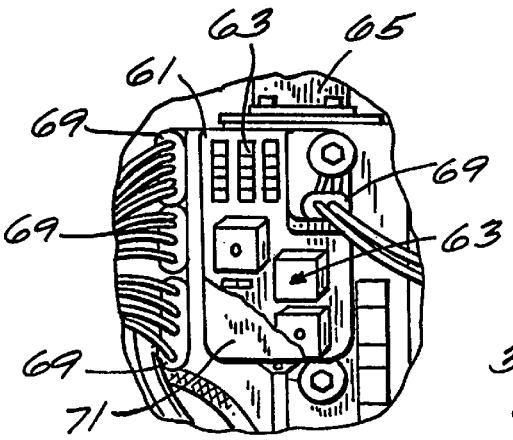
FIG. 3 is a fragmentary, enlarged view of a sealed housing or box included in the outboard motor shown in FIGS. 1 and 2.
Figure 1:
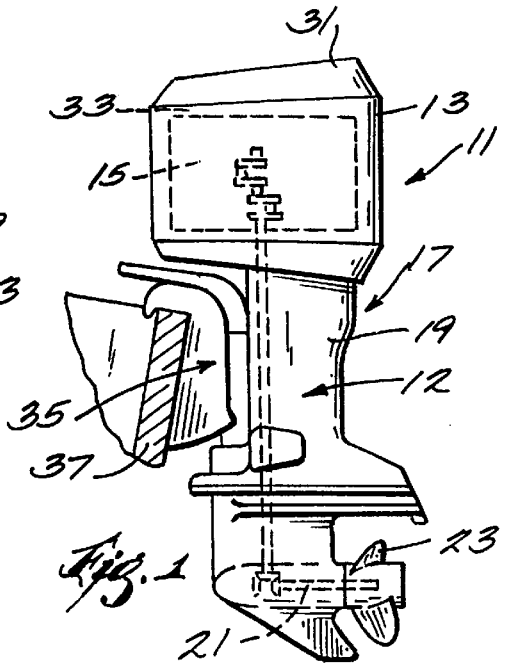
FIG. 1 is an elevational view of an outboard motor embodying various of the features of the invention.
Figure 2:
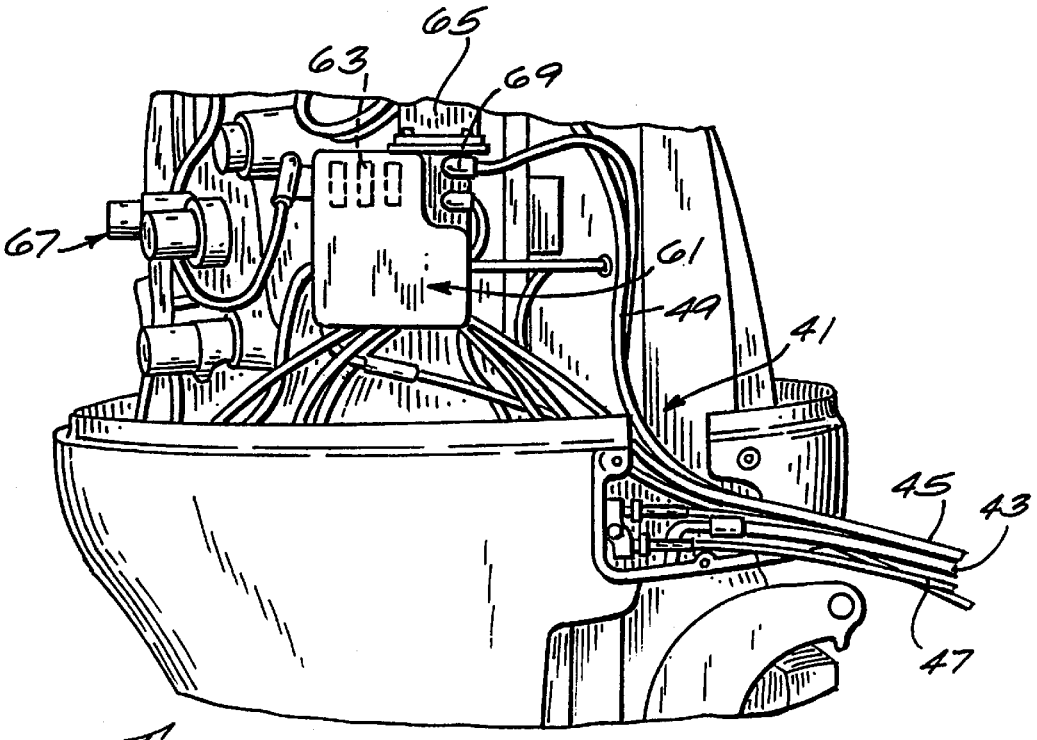
FIG. 2 is an a enlarged view of the outboard motor shown in FIG. 1 with the outer cowling removed.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown in the drawings is a marine propulsion device in the form of an outboard motor 11 comprising a propulsion unit 12 including a power head 13 which includes an internal combustion engine 15, and a lower unit 17 including a drive shaft housing 19 fixed to the engine 15, and a propeller shaft 21 journalled by the lower unit 17, driven by the engine 15, and having thereon a propeller 23. The outboard motor 11 also includes an outer cowling or engine cover 31 extending downwardly to the drive shaft housing 19 and defining an enclosure or space or volume 33 containing the engine 15, and bracket means 35 connected to the propulsion unit 12 and adapted to be mounted on a transom 37 of a boat for permitting steering movement of the propulsion unit 12 about a generally vertical axis relative to the boat and tilting movement of the propulsion unit about a generally horizontal axis relative to the boat.

The outboard motor 11 also includes an opening or aperture 41 which is located in the starboard side of one of the cowling 31 and the drive shaft housing 19, which communicates with the engine enclosure 33, and through which all fuel, oil, electrical, shift, and throttle lines enter the enclosure 33. More specifically, the outboard motor 11 includes a fuel line 43 entering through the opening 41 into the engine enclosure 33, a shift cable 45 entering through the opening 41 into the engine enclosure 33, a throttle cable 47 entering through the opening 41 into the engine enclosure 33, and an electrical power line or battery cable 49 entering through the opening 41 into the engine enclosure 33. Other lines, such as an auxiliary lighting circuit line, an oil supply line, and an ignition starting line, (and can also enter the enclosure 33 through the opening 41. As above described, the construction is conventional.

The outboard motor 11 also includes a centralized rigging area or system includes a sealed electrical connection assembly or housing or box 61 which is preferably located or mounted on the upper starboard side of the engine 15 within the engine enclosure 33, which is sealed against entry of moisture, and which preferably includes a fuse and relay assembly 63 including a plurality of fuses and relays, a starter solenoid 65 for an electric starting motor (not shown), a suppressor assembly 67, and a plurality of water tight plug-in connections 69 adapted to be received and to be electrically connected to the battery cable 49 and to other remotely located systems, indicators, and controls, as well as to components of the ignition system.

The fuse and relay assembly 63 includes a plurality of fuses and relays, i.e., all of the fuses and relays needed to run the outboard motor 11, and is located in the sealed box or housing 61. Included in the box or housing 61 is a removable cover or door 71 affording access to the fuses and relays if service is required.

In addition, the water tight plug-in type connectors 69 are located on the exterior of the sealed box or housing 61 so as to permit entry into the sealed box or housing 61 of all remote wiring. In addition, all circuit connections, such as, for example, between the battery cable 49 and the starter solenoid 65, and between the battery cable 49 and the ignition and charging circuits, are made internally of the sealed housing or box 61 and through the plug-in connections 69.

The starter solenoid 65 is mounted to the sealed box or housing 61 of the centralized rigging assembly to provide easy electrical accessibly from the box or housing 61 and so as to facilitate battery cable connections which are located high on the power head 13 and away from potential corrosion. Twelve volt power for all electrical requirements is distributed through the plug-in connections 69.

The suppressor assembly 67 is employed as a protection for loose or corroded battery terminals. It is preferred to mount the suppressor assembly on the sealed housing or box 61. However, in the disclosed construction, because the bulk of the suppressor assembly 67 interfered with mounting of the engine cowling 31 on the drive shaft housing 19, the suppressor assembly 67 is located on a bracket (not specifically shown) which acts as a heat sink for the suppressor assembly and which is fixed on the cylinder block of the engine 15.

As already noted, all electrical connections from remotely located controls or systems are located are obtained through the plug-in connectors located on the starboard side of the motor 11 at the centralized rigging area. Accordingly, when rigging the outboard motor 11 on a boat, all incoming wiring is routed to one location, i.e., the upper starboard area on the power head 13, whereby to simplify rigging, save time, and reduce the chance for error in wire routing.

The disclosed construction advantageously provides a single location high on the power head 13 where all electrical connections are made when the outboard motor 11 is rigged on the boat. Having such a single high location for all connections will 1) reduce the chance for errors in wire routing; 2) keep all connections high on the power head 13 where they can be easily made and kept away from any moisture inside the cowling 31 to reduce corrosion; 3) provide a sealed compartment for all fuses and relays; and 4) clean up wiring on the power head.

The disclosed construction also simplifies the rigging process and makes it more "goof-proof". Connections are readily accessible and are located away from potential corrosion. Fuses and relays are sealed and protected against corrosion. In addition, overall power head wiring and appearance are improved. All of these advantages make the outboard motor easier to rig and service and enhance customer satisfaction.

What is claimed is:

1. An outboard motor comprising:

a propulsion unit including a powerhead which includes an internal combustion engine, a lower unit driven by the engine and having thereon a propeller; the lower unit driven by the engine and having thereon a propeller;

a cowling extending over the engine and downwardly to said drive shaft housing, said cowling defining an enclosed space containing the engine;

an opening to the enclosed space comprising a necked inlet, said necked inlet extending through at least one of said cowling and said drive shaft housing to the juncture between the cowling and the drive shaft housing;

a plurality of electrical control cables entering said enclosed space through said opening for controlling operation of said engine; and a housing mounted to a side of the engine and being sealed from moisture, said housing containing a plurality of electrical devices for operating said engine and having a plurality of external water tight connections for electrical connection to said devices;

wherein said cables connect to preselected connections on said housing.

2. The outboard motor of claim 1 where said connections are plug-in electrical connections.

3. The outboard motor of claim 1 wherein said electrical control cables include a battery cable.

4. The outboard motor of claim 1 wherein said cables include an ignition starting cable.

5. The outboard motor of claim 1 wherein said cables include an auxiliary lighting circuit cable.

6. The outboard motor of claim 1 wherein said housing is mounted on the starboard side of said engine.

7. The outboard motor of claim 1 wherein said electrical devices include a fuse and relay assembly.

8. The outboard motor of claim 1 wherein said electrical devices include a starter solenoid.

9. The outboard motor of claim 1 wherein said housing is provided with a removable cover for accessing the interior of the housing.

10. The outboard motor of claim 1 wherein said housing is spaced from said drive shaft housing.

11. The outboard motor of claim 1 wherein a throttle cable also enters the enclosed space defined by said cowling through said opening.

12. The outboard motor of claim 1 wherein a fuel line also enters the enclosed space defined by said cowling through said opening.

13. The outboard motor of claim 1 wherein an oil line also enters the enclosed space defined by said cowling through said opening.

14. The outboard motor of claim 1 wherein said opening is on the starboard side of said engine.

15. An outboard motor comprising:

an internal combustion engine and a drive shaft housing extending from said engine;

a cowling extending over said engine and to said drive shaft housing, said cowling defining an enclosed space including said engine;

an opening to said enclosed space comprising a necked inlet, said necked inlet extending through at least one of said cowling and said drive shaft housing to a junction between said cowling and said drive shaft housing;

a plurality of electrical control cables entering said enclosed space through said opening for controlling operation of said engine;

a housing mounted on a side of said engine; and a plurality of external water tight electrical connections mounted to said housing.

16. The outboard motor of claim 15 wherein said electrical control cables connect to preselected said connections mounted to said housing.

17. The outboard motor of claim 16 wherein said connections are plug-in electrical connections.

18. The outboard motor of claim 15 wherein electrical devices are located within said housing, said devices comprising at least two from a group of devices comprising a fuse, a relay, a starter solenoid, a suppressor assembly, and an electrical plug-in connection adapted to be connected to a battery cable.

19. The outboard motor of claim 15 wherein said opening is on a starboard side of said engine.

20. The outboard motor of claim 15 wherein said housing is mounted on a starboard side of said engine in close proximity to said opening.

* * * * *